US005976040A

United States Patent [19]

Liu

[11] Patent Number: 5,976,040

[45] Date of Patent: Nov. 2, 1999

[54] BLADE MEMBER OF A HOCKEY STICK HAVING A VISIBLE MARK

[76] Inventor: Chao-Jih Liu, No. 166, Kung-Yeh Rd., Lung-Ching Hsiang, Taichung Hsien, Taiwan

[21] Appl. No.: 09/098,069

[22] Filed: Jun. 16, 1998

[51] Int. Cl.[6] ..... A63B 59/14

[52] U.S. Cl. ..... 473/563

[58] Field of Search ..... 973/560–568, 973/FOR 189

[56] References Cited

U.S. PATENT DOCUMENTS

| | | | |
|---|---|---|---|
| 3,561,760 | 2/1971 | Klay | 473/563 |
| 5,160,135 | 11/1992 | Hasegawa | 473/561 |
| 5,558,326 | 9/1996 | Adamson et al. | 473/563 |
| 5,836,841 | 11/1998 | Fell | 473/563 |

FOREIGN PATENT DOCUMENTS

| | | | |
|---|---|---|---|
| 2487208 | 1/1982 | France | 473/189 |
| 2018138 | 10/1979 | United Kingdom | 473/189 |

*Primary Examiner*—Mark S. Graham

*Attorney, Agent, or Firm*—Lackenbach Siegel Marzullo Aronson & Greenspan, P.C.

[57] ABSTRACT

A blade member of a hockey stick defines a profile, and includes an elongated blade body having a front toe end, a rear heel end, a pair of attachment walls which laterally oppose each other and which respectively extend from the rear heel end toward the front toe end, two flange units that project outwardly and laterally from bottoms of the attachment walls to define two accommodating spaces above the flange units, and a connecting portion that extends integrally, rearwardly and upwardly from the rear heel end. A display sheet is disposed in one of the accommodating spaces to abut against one of the attachment walls, has an outer abutment face with a mark. A transparent sheath is produced by a process that includes: (1) preparing a mold having a molding cavity of a shape corresponding to the profile of the blade member; (2) placing an assembly of the blade body and the display sheet in the cavity in such a manner that the bottoms of the attachment walls and the flange units abut against the mold in the molding cavity, and that remainder of the assembly form clearances with the mold in the cavity; and (3) filling the clearances with a transparent plastic material so as to form the transparent sheath for viewing of the mark from an exterior of the blade member.

3 Claims, 4 Drawing Sheets

BLADE MEMBER OF A HOCKEY STICK HAVING A VISIBLE MARK

BACKGROUND OF THE INVENTION

1. Field of the Invention

The invention relates to a blade member, more particularly to a blade member which is adapted to be connected to a handle portion of a hockey stick and which is provided with a visible mark that is protected against wearing.

2. Description of the Related Art

Referring to FIG. 1, a conventional blade member 2 for a hockey stick generally includes a rigid plastic blade body 2*a* and a covering sheath 2*b*. The blade body 2*a* has a front toe end, a rear heel end, a pair of opposing lateral walls 2*d* respectively extending from the rear heel end toward the front toe end, and a connecting portion 2*c* which extends integrally, rearwardly and upwardly from the rear heel end and adapted to be connected to a handle 1 portion.

The covering sheath 2*b* is sleeved from the front toe end so as to enclose the lateral walls 2*d* of the blade body 2*a*. The external surface of the covering sheath 2*b* is generally provided with some mark, such as by printing mark, for advertising purposes. However, the mark eventually wear off due to continued use of the conventional blade member 2.

SUMMARY OF THE INVENTION

Therefore, the object of this invention is to provide a blade member for a hockey stick which is provided with a visible mark that is protected against wearing.

Accordingly, a blade member of this invention is adapted to be connected to a handle portion of a hockey stick and defines a profile, and includes an elongated blade body, a display sheet, and a plastic transparent sheath. The blade body has a front toe end, a rear heel end, a pair of attachment walls which laterally oppose each other and which respectively extend from the rear heel end toward the front toe end, and a pair of flange units that project outwardly and laterally from bottoms of the attachment walls so as to define a pair of accommodating spaces above the flange units. The blade body further has a connecting portion that extends integrally, rearwardly and upwardly from the rear heel end, and that is adapted to be connected to the handle portion. The display sheet has an inner abutment face disposed in one of the accommodating spaces to abut against one of the attachment walls, and an outer abutment face with a mark provided thereon.

The transparent sheath is produced by a process including the steps of: (1) preparing a mold having a molding cavity of a shape corresponding to the profile of the blade member; (2) placing an assembly of the blade body and the display sheet in the molding cavity in such a manner that the bottoms of the attachment walls and the flange units abut against the mold in the molding cavity, and that remainder of the assembly form clearances with the mold in the molding cavity; and (3) filling the clearances with a transparent plastic material so as to form the transparent sheath, thereby permitting viewing of the mark on the display sheet from an exterior of the blade member.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
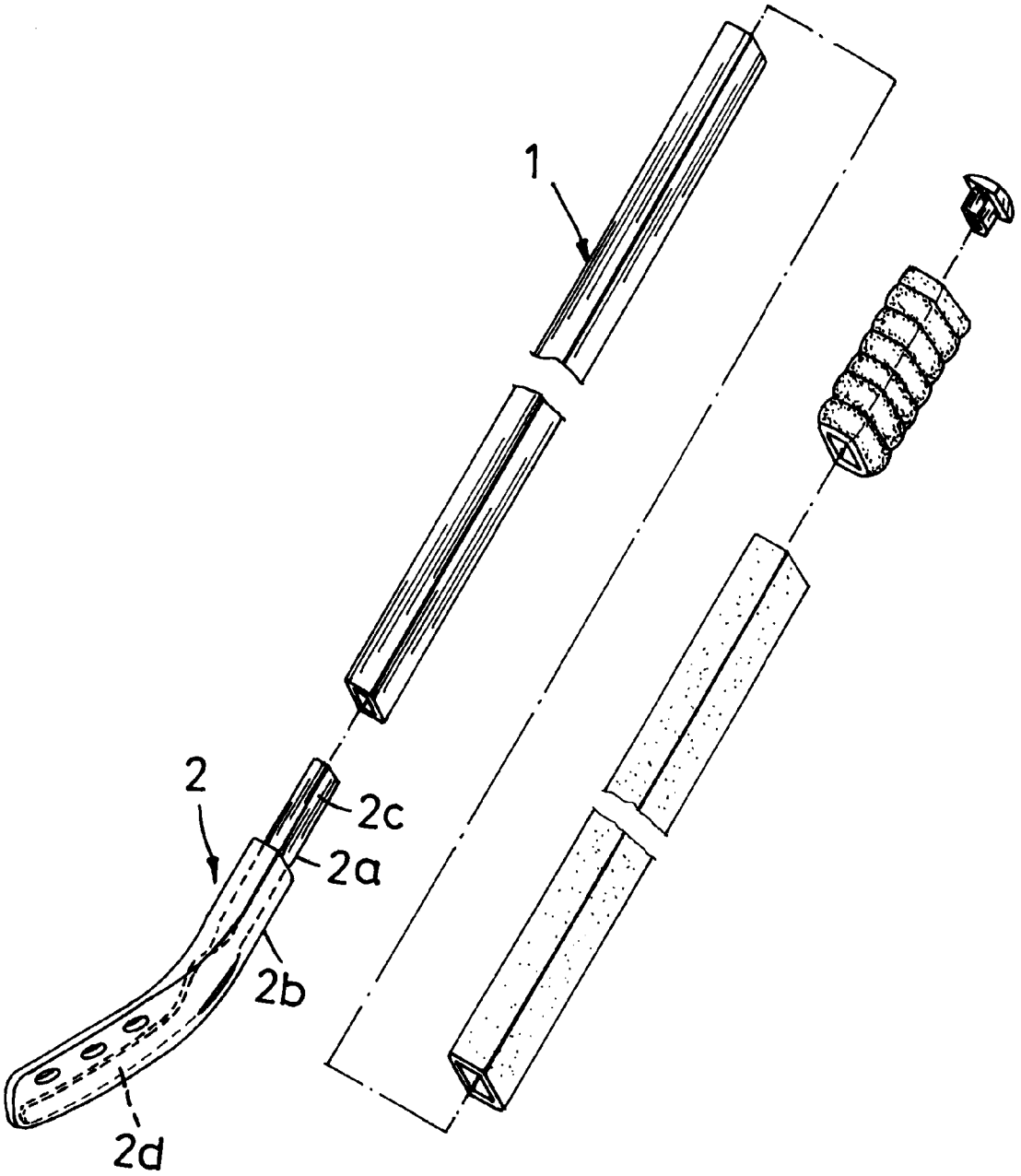
FIG.1 PRIOR ART
FIG. 1 is an exploded view of a conventional blade member that is adapted to be connected to the handle portion of a hockey stick.
Figure 2:
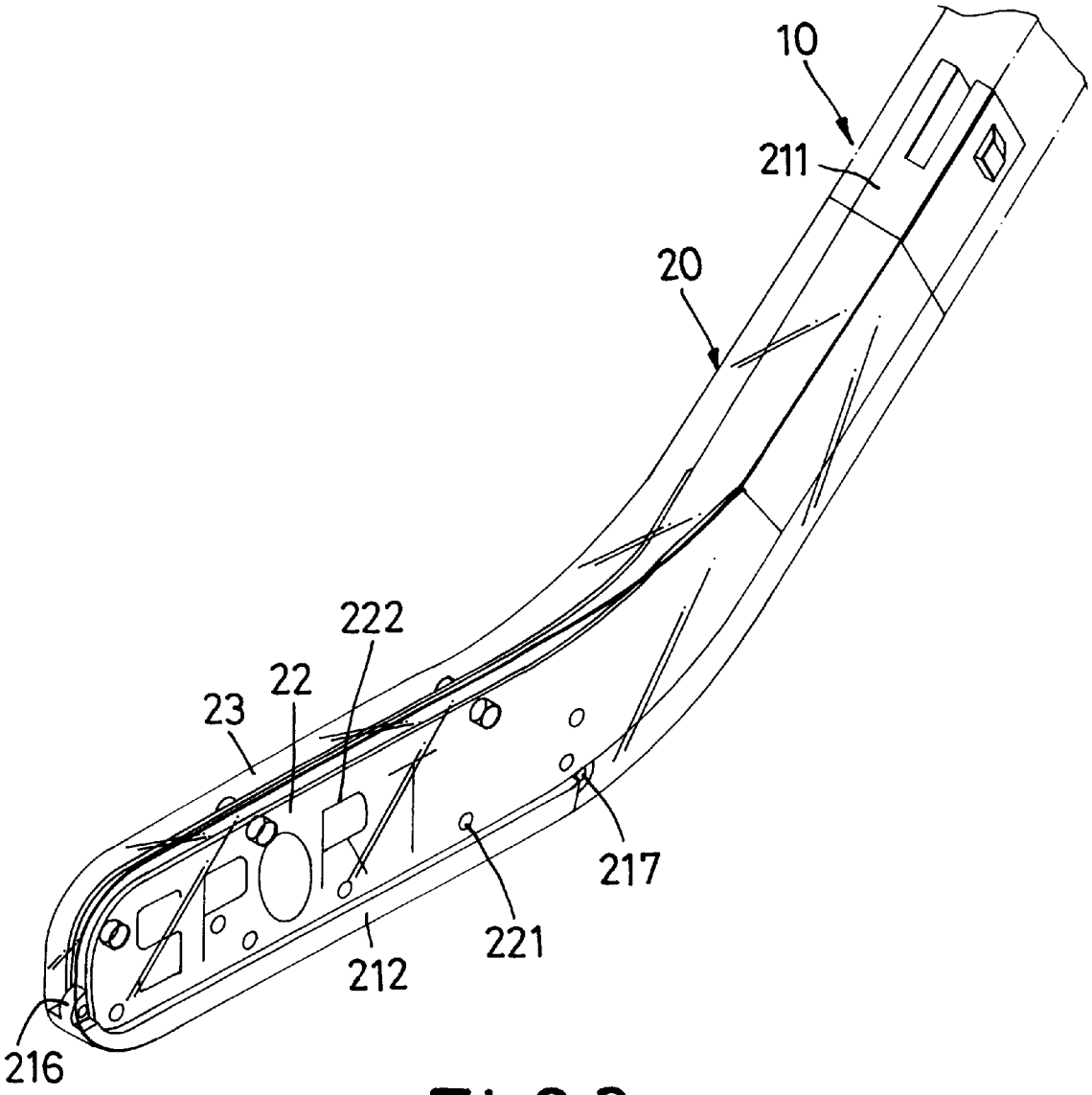
FIG. 2 is a perspective view of a blade member of this invention that is adapted to be connected to the handle portion of a hockey stick.
Figure 3:
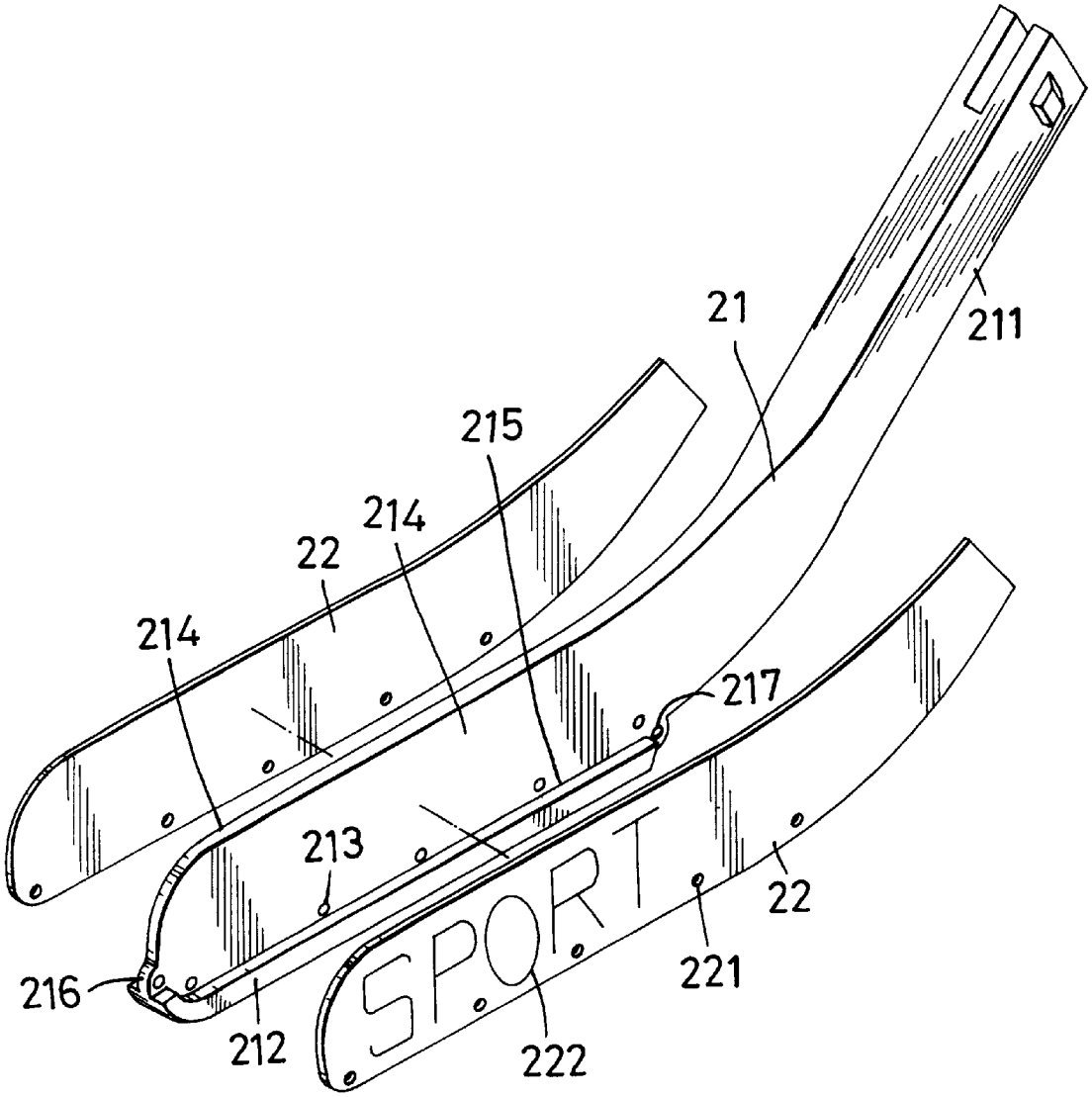
FIG. 3 is an exploded view of the preferred embodiment, wherein a plastic transparent sheath is removed for the sake of clarity.
Figure 4:
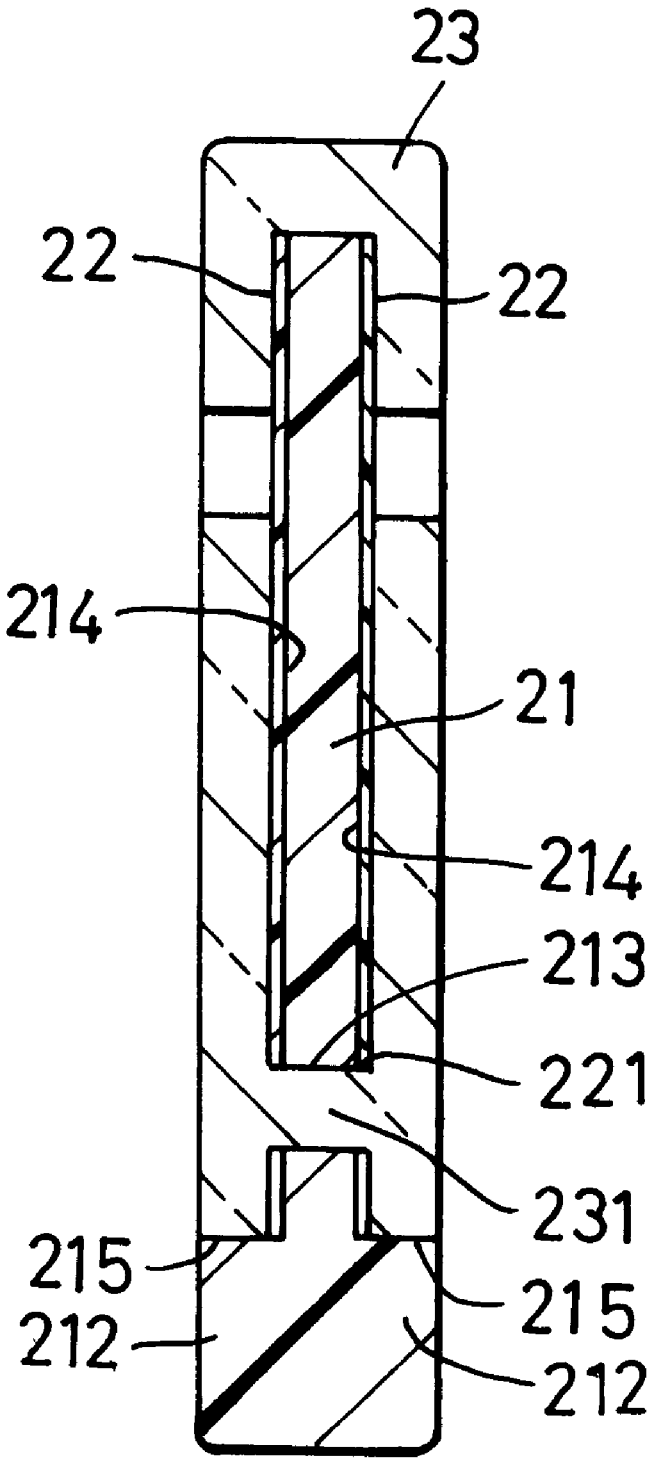
FIG. 4 is a sectional view of the preferred embodiment.

Referring to FIGS. 2, 3 and 4, the preferred embodiment of a blade member 20 of this invention is adapted to be connected to the handle portion 10 of a hockey stick, and has a predetermined profile. As illustrated, the blade member 20 includes an elongated blade body 21, two display sheets 22, and a plastic transparent sheath 23.

The blade body 21 has a front toe end 216, a rear heel end 217, a pair of attachment walls 214 which laterally oppose each other and which respectively extend from the rear heel end 217 toward the front toe end 216, and a pair of flange units 212 that project outwardly and laterally from bottoms of the attachment walls 214 so as to define a pair of accommodating spaces 215 above the flange units 212. The blade body 21 further has a connecting portion 211 that extends integrally, rearwardly and upwardly from the rear heel end 216, and that is adapted to be connected to the handle portion 10 (see FIG. 2).

Each of the display sheets 22, which are preferably made of paper, has an inner abutment face disposed in a respective one of the accommodating spaces 215 to abut against a corresponding one of the attachment walls 214, and an outer abutment face with a mark matter 222 provided thereon, such as by printing.

The transparent sheath 23 is produced by a process that includes the steps of:

(i) preparing a mold (not shown) having a molding cavity of a shape corresponding to the profile of blade member 20;

(ii) placing an assembly of the blade body 21 and the display sheet 22 in the molding cavity in such a manner that the bottoms of the attachment walls 214 and the flange units 212 abut against the mold in the molding cavity, and that remainder of the assembly form clearances with the mold in the molding cavity; and (iii) filling the clearances with a transparent plastic material so as to form the transparent sheath 23, thereby permitting viewing of the mark 222 on the display sheet 22 from an exterior of the blade member 20.

In the preferred embodiment, the blade body 21 further has a first through hole 213 that extends transversely relative to a longitudinal length of the blade body 21 to communicate the accommodating spaces 215. The display sheet 22 has a second through hole 221 formed therethrough and in alignment with the first through hole 213. The transparent sheath 23 further has a reinforcing transverse rib 231 that extends through the first and second through holes 213, 221 so as strengthen mounting of the transparent sheath 23 on the blade body 21.

Note that the blade body 21 is a molded single piece structure such that the flanges 212 are integrally formed with the attachment walls 214. The blade body 21 is made from a plastic material having a higher melting point than that of the plastic transparent sheath 23.

A process of this invention for producing a blade member 20 that is adapted to be connected to the handle portion 10 of a hockey stick includes the following steps:

(i) providing a single piece structure of an elongated blade body 21 having a front toe end 216, a rear heel end 217, a pair of attachment walls 214 laterally opposing each other and respectively extending from the rear heel end 217 toward the front toe end 216, and a pair of flange units 212 projecting outwardly and laterally from bottoms of the attachment walls 214 so as to define a pair of accommodating spaces 215 above the flange units 212, the blade body 21 further has a connecting portion 211 that extends integrally, rearwardly and upwardly from the rear heel end 217, and adapted to be connected to the handle portion 10;

(ii) providing two display sheets 22 respectively having an inner abutment face to be disposed in a respective one of the accommodating spaces 215 to abut against a corresponding one of the attachment walls 214, and an outer abutment face with a mark 222 provided thereon;

(iii) bringing the display sheets 22 to abut against the blade body 21 so as to form an assembly of the blade body 21 and the display sheets 22;

(iv) preparing a mold having a molding cavity of a shape corresponding to the profile of the blade member 20;

(v) placing the assembly in the molding cavity in such a manner that the bottoms of the attachment walls 214 and the flange units 212 abut against the mold in the molding cavity, and that remainder of the assembly form clearances with the mold in the molding cavity; and (vi) filling the clearances with a transparent plastic material so as to form a transparent sheath 23, thereby permitting viewing of the mark 222 on the display sheets 22 from an exterior of the blade member 20.

Because the display sheets 22 are enclosed permanently within the transparent sheath 23, the marks 222 are protected against wearing.

With this invention thus explained, it is apparent that numerous modification and variations can be made without departing from the scope and spirit of this invention. It is therefore intended that this invention be limited only as indicated in the appended claims.

I claim:

1. A blade member adapted to be connected to a handle portion of a hockey stick, said blade member defining a profile, and comprising:

an elongated blade body having a front toe end, a rear heel end, a pair of attachment walls laterally opposing each other and respectively extending from said rear heel end toward said front toe end, and a pair of flange units projecting outwardly and laterally from bottoms of said attachment walls so as to define a pair of accommodating spaces above said flange units;

a connecting portion extending integrally, rearwardly and upwardly from said rear heel end, and adapted to be connected to the handle portion; and at least one display sheet having an inner abutment face disposed in one of said accommodating spaces to abut against one of said attachment walls, and an outer abutment face with a mark provided thereon; and a plastic transparent sheath produced by a process including the steps of:

(i) preparing a mold having a molding cavity of a shape corresponding to the profile of said blade member;

(ii) placing an assembly of said blade body and said display sheet in said molding cavity in such a manner that the bottoms of said attachment walls and said flange units abut against said mold in said molding cavity, and that remainder of said assembly forms clearances with said mold in said molding cavity; and (iii) filling said clearances with a transparent plastic material so as to form said transparent sheath, thereby permitting viewing of said mark on said display sheet from an exterior of said blade member.

2. The blade member as defined in claim 1, wherein said blade body further has a first through hole extending transversely relative to a longitudinal length of said blade body to communicate said accommodating spaces, said display sheet having a second through hole formed therethrough and in alignment with said first through hole, said transparent sheath further having a reinforcing transverse rib extending through said first and second through holes so as strengthen mounting of said transparent sheath on said blade body.

3. A process for producing a blade member that is adapted to be connected to the handle portion of a hockey stick, the blade member defining a profile, the process comprising the steps:

(i) providing a single piece structure of an elongated blade body having a front toe end, a rear heel end, a pair of attachment walls laterally opposing each other and respectively extending from the rear heel end toward the front toe end, and a pair of flange units projecting outwardly and laterally from bottoms of the attachment walls so as to define a pair of accommodating spaces above the flange units, said blade body further having a connecting portion extending integrally, rearwardly and upwardly from the rear heel end, and adapted to be connected to the handle portion; and (ii) providing at least one display sheet having an inner abutment face to be disposed in one of the accommodating spaces to abut against one of the attachment walls, and an outer abutment face with a mark provided thereon;

(iii) bringing said display sheet to abut against the blade body so as to form an assembly of the blade body and the display sheet;

(iv) preparing a mold having a molding cavity of a shape corresponding to the profile of the blade member;

(v) placing the assembly in the molding cavity in such a manner that the bottoms of the attachment walls and the flange units abut against the mold in the molding cavity, and that remainder of the assembly form clearances with the mold in the molding cavity; and (vi) filling the clearances with a transparent plastic material so as to form a transparent sheath, thereby permitting viewing of the mark on the display sheet from an exterior of the blade member.

* * * * *